United States Patent [19]

Longworth

[11] 4,409,890

[45] * Oct. 18, 1983

[54] FUME CUPBOARD

[76] Inventor: Archibald L. Longworth, Mirador, Woodbrook Rd., Alderley Edge, Cheshire, SK9 7BZ, England

[ * ] Notice: The portion of the term of this patent subsequent to Jul. 28, 1998 has been disclaimed.

[21] Appl. No.: 261,395

[22] Filed: May 7, 1981

Related U.S. Application Data

[63] Continuation-in-part of Ser. No. 42,666, May 25, 1979, Pat. No. 4,280,400.

[30] Foreign Application Priority Data

May 30, 1978 [GB] United Kingdom ..... 24508/78

[51] Int. Cl.[3] ..... F23J 11/00

[52] U.S. Cl. ..... 98/115 LH

[58] Field of Search ..... 98/115 R, 115 LH; 55/DIG. 18

[56] References Cited

U.S. PATENT DOCUMENTS

| | | | |
|---|---|---|---|
| 2,702,505 | 2/1955 | Nelson | 98/115 LH |
| 3,000,292 | 9/1961 | Wojan | 98/115 LH |
| 3,318,227 | 5/1967 | Nelson et al. | 98/115 LH |
| 3,340,788 | 9/1967 | Landingham et al. | 98/115 LH |
| 3,747,505 | 7/1973 | Turko | 98/115 LH |
| 4,134,331 | 1/1979 | Bender | 98/115 LH |
| 4,214,455 | 7/1980 | Wyden | 98/115 R X |

FOREIGN PATENT DOCUMENTS

| | | | |
|---|---|---|---|
| 323972 | 8/1920 | Fed. Rep. of Germany | 98/115 R |
| 491033 | 8/1938 | United Kingdom | 98/115 R |
| 324457 | 11/1972 | U.S.S.R. | 98/115 LH |

*Primary Examiner*—Albert J. Makay
*Assistant Examiner*—Harold Joyce
*Attorney, Agent, or Firm*—Sughrue, Mion, Zinn, Macpeak and Seas

[57] ABSTRACT

A fume cupboard with a ventilated enclosure having an access opening along an edge of which is a cowling for improving containment of the cupboard. The cowling is shaped such that there is a streamlined air flow over the cowling into the enclosure the cowling having a sloped portion extending into the enclosure over which the streamlined flow is divergent with respect to the main air flow into the enclosure. The cowling is positioned such that an air flow channel is defined between the cowling and the edge. The air passing through the channel into the enclosure as well as the streamlined air flow over the cowling avoid the production of eddies at the edge of the enclosure and co-operate to produce a non-turbulent air stream passing into the enclosure and opposing outward movement of eddies within the cupboard.

12 Claims, 5 Drawing Figures

FUME CUPBOARD

This application is a continuation-in-part of my earlier application No. 042,666 filed May 25, 1979 now U.S. Pat. No. 4,280,400.

BACKGROUND OF THE INVENTION

The present invention relates to fume cupboards, ventilated cupboards, ventilated cabinets, ventilated hoods and like apparatus (hereinafter collectively referred to as fume cupboards) used for providing aerial containment for gases, vapours, dusts, bacteria and other materials, for example in chemical laboratories.

A fume cupboard is a ventilated enclosure within which operations may be conducted for the purpose of avoiding release of toxic material or the like into a room in which people may be working. The fume cupboard is associated with a fan for drawing air and toxic material from the enclosure for safe discharge, usually to atmosphere, and is also provided with an opening which allows access to the enclosure and through which air is drawn to replace that withdrawn by the fan. A problem with such cupboards however is that the flow of air through the cupboard is not streamlined and eddies are formed, particularly at corners of the cupboard and in the region of the edges of the opening, which results in air and hence toxic material, flowing back through the opening of the cupboard, which is obviously undesirable. It is found that increasing the velocity of air entering the cupboard through the opening helps, to a certain extent, to improve containment and, in this respect, there are recommended air velocities at which cupboards should operate to provide adequate containment. However, simply increasing the air velocities to improve containment is not satisfactory, since above a particular velocity it may be found that containment is actually poorer than at lower velocities. Additionally the use of high air velocities means that more air must be driven from the room in which the cupboard is situated. Obviously, this increases the costs for maintaining the room air at a suitable temperature.

SUMMARY OF THE INVENTION

It is an object of the present invention to provide a fume cupboard with improved containment.

According to the present invention there is provided a fume cupboard comprising a ventilated enclosure having an access opening with an edge and a cowling provided along said edge and spaced therefrom such that an air flow channel is defined between the edge and the cowling through which air may be drawn during use of the cupboard from the exterior to the interior of the enclosure, said cowling being shaped such that there is a streamlined air-flow over the cowling into the enclosure when the cupboard is in use, and said cowling having a first portion located outwardly of the enclosure and a second portion sloping into the enclosure such that the streamlined air flow over said second portion is divergent relative to the main air flow into the cupboard through the access opening.

Cowlings may be provided along a basal edge of the access opening, along one or more side edges thereof, and/or along an upper edge of the opening, e.g. along the lower edge of a sash window which may be fixed or slidable.

The cowlings are particularly suitable for use on edges of the access opening which are associated with an inner surface of the enclosure. Thus a basal edge of the cupboard may be associated with a floor surface of the enclosure, in which case the second portion of the cowling will slope into the cupboard towards the floor surface such that the second streamlined air flow over the portion is divergent relative to the main air flow passing through the access opening. Similarly side edges of the access opening may be associated with respective interior side walls of the enclosure and a cowling provided on such an edge will have its second portion sloping into the cupboard towards the associated side wall.

In the case of a cowling provided along an upper edge of the access opening the second portion of the cowling will slope upwardly into the enclosure.

The cowling serves a dual function. Firstly, the air-flow channel directs a stream of air into the enclosure thereby opposing forward flow of material out of the cupboard.

Secondly, the shape of the cowling is such that the layers or streamlines of the air-flow over the cowling are smooth and substantially free of eddies (i.e. the flow is streamlined), thereby substantially preventing backflow. This avoidance of backflow ensures that any material in the vicinity of the cowling is directed in the streamlined air-flow into the enclosure thereby providing a further improvement in containment.

Numerous cross-sectional shapes are possible for the cowling. Preferably however the streamlined air-flow over the first portion of the cowling is convergent with respect to the main air-flow through the access opening. This first portion is preferably convex with respect to the streamlined air flow. The second portion of the cowling i.e. that portion providing the divergent flow may be plane or may be convex to the divergent air flow. An example of a suitable cowling is one of aerofoil cross-section.

It is possible for the present invention to be applied to the modification of an existing fume cupboard so as to increase its containment.

The invention thus also provides a conversion kit for a fume cupboard comprising a ventilated enclosure having an access opening with an edge, the kit the kit comprising a cowling for location along said edge and spaced therefrom such that an air flow channel is defined between the edge and the cowling, when fitted, through which air may be drawn during use of the cupboard from the exterior to the interior of the enclosure, said cowling being shaped such that there will be a streamlined air-flow over the cowling, when fitted, into the enclosure when the cupboard is in use, and said cowling having a first portion for location outwardly of the enclosure and a second portion for sloping into the enclosure such that the streamlined air flow over said second portion is divergent relative to the main air flow into the cupboard through the access opening.

Any suitable means may be used for mounting the cowling along the edge such that an air flow channel is defined between the cowling and the edge.

BRIEF DESCRIPTION OF THE DRAWINGS

The invention will be further described by way of example with reference to the accompanying drawings, in which.

DETAILED DESCRIPTION OF THE DRAWINGS

Figure 1:
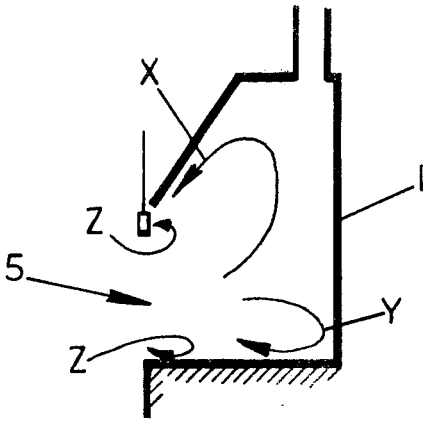
FIG. 1 diagrammatically illustrates eddies within a fume cupboard.

FIG. 1 illustrates troublesome eddies within a typical fume cupboard 1. The principal eddies are;

(i) an eddy X above the level of the opening 5 of the cupboard 1 producing a downflow of contaminated air from the top of the cupboard over the internal surface of the cupboard front;

(ii) an eddy Y on a horizontal axis across the back of the cupboard at low level causing a forward movement of contaminated air towards the opening of the cupboard;

(iii) eddies Z at all four edges of the cupboard opening producing a forward flow of contaminated air towards the opening of the cupboard; and (iv) further eddies (not shown) on a vertical axis at both sides of the cupboard producing a forward flow of air along the side walls directed towards the opening.

Figure 2:
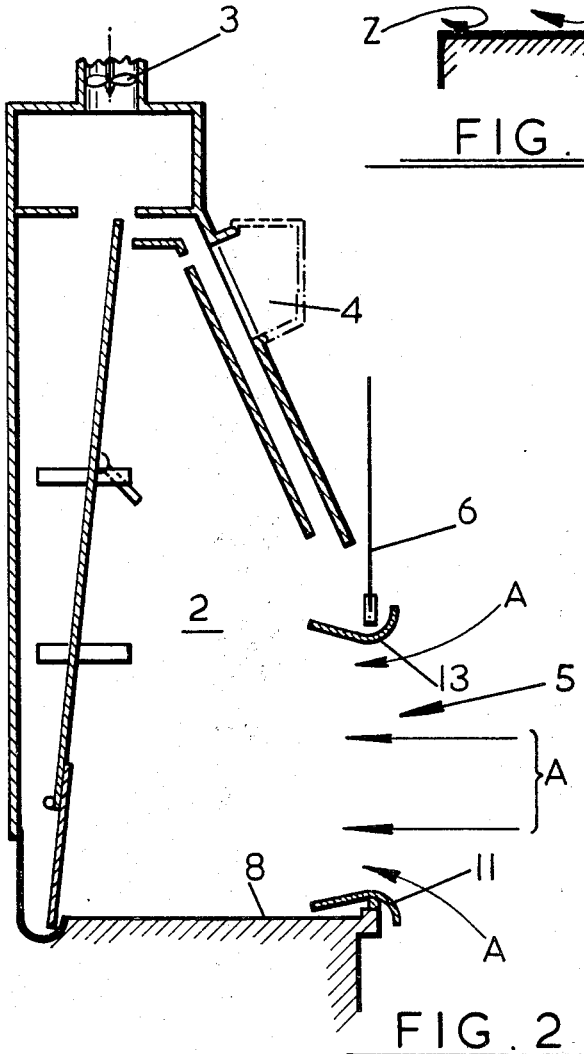
FIG. 2 shows a diagrammatic sectional view of a fume cupboard in accordance with the invention.
Figure 3:
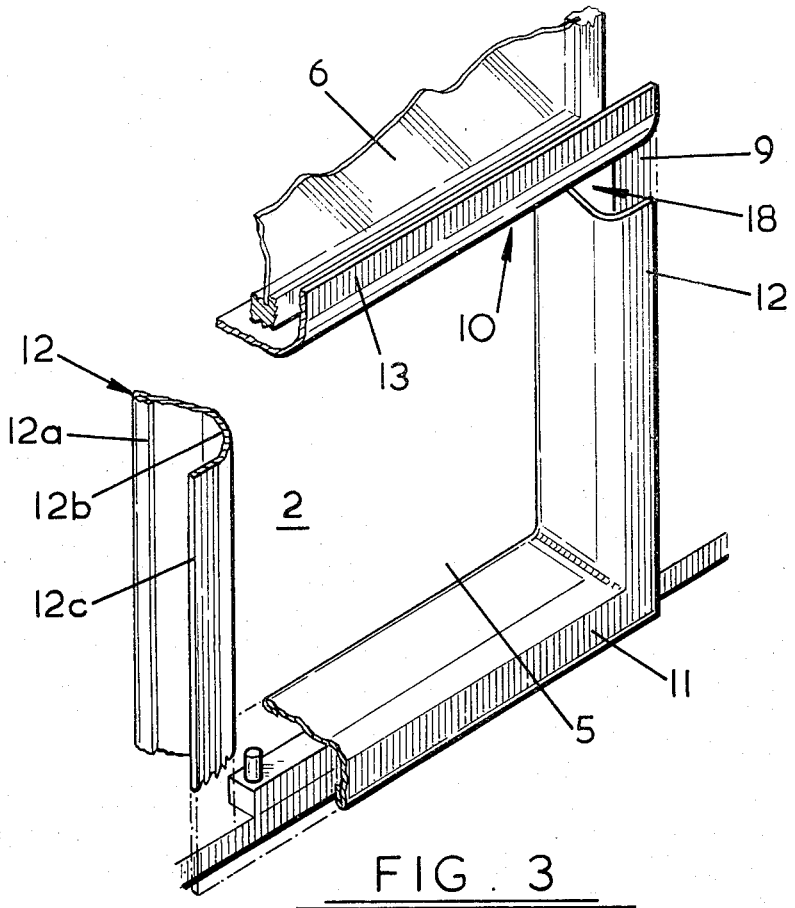
FIG. 3 is a perspective view of the access opening of the cupboard shown in FIG. 2.
Figure 4:
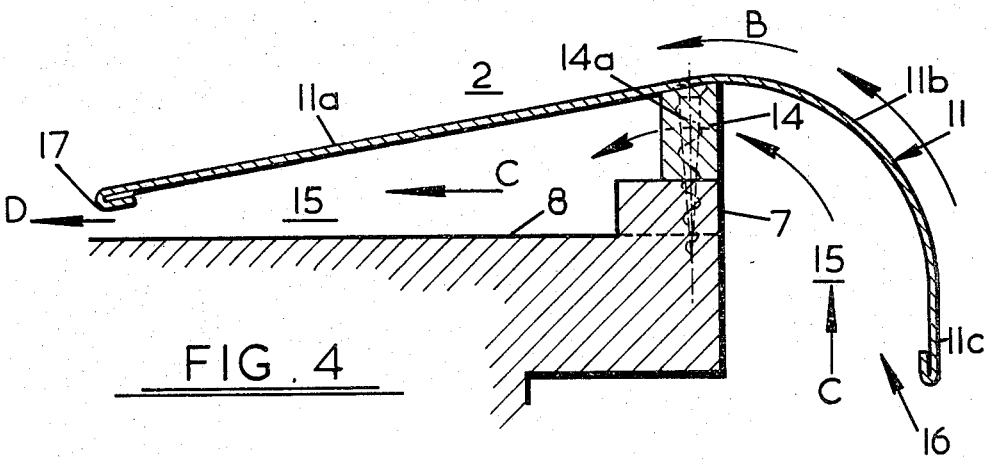
FIG. 4 is a diagrammatic sectional view of the lower edge of the fume cupboard shown in FIG. 2, including details of the cowling.

FIG. 2 diagrammatically illustrates the cross-section of a typical fume cupboard 1. This cupboard has an interior working enclosure 2 ventilated by a fan 3 and illuminated by a light 4. A frontal opening 5 closeable by a sash window 6 serves to allow access to the enclosure 2. The access opening is defined by a lower edge or sill 7 (FIG. 4) associated with the floor surface 8 of the enclosure 2, two side edges 9 each adjacent and associated with side surfaces 10 of the enclosure 2 (see FIG. 3), and the lower edge of sash window 6.

An aerofoil section cowling 11, described in more detail below is provided along the lower sill 7. Similar cowlings 12 and 13 are provided respectively along edges 9 and the lower edge of sash window 6.

The fume cupboard also has an internal baffle arrangement which is described in my copending application No. 042,666 (incorporated herein by reference), and consequently no further description of this arrangement will be given.

Cowling 11 provided along lower sill 7 is of generally aerofoil shape cross-section and includes a plane portion **11*a* extending downwards into the enclosure 2 (i.e. towards the floor surface 8), an arcuate portion 11*b* overhanging the sill 7, and a plane portion 11*c* extending downwardly from the arcuate portion and positioned in front of the sill 7**.

The cowling 11 is positioned on spacers 14 provided at intervals along the sill 7 such that an air flow channel 15 is defined around the sill 7 beneath cowling 11. Screws **14*a* may be used to affix cowling 11 and spacers 14 in position. This channel 15 has its entrance 16 between the free edge of plane portion 11*c* and the front surface of the fume cupboard. The exit 17 of the channel is effectively a nozzle defined between the free edge of plane portion 11*a* and the floor surface 8 of the enclosure. Intermediate the entrance 16 and exit 17 the channel turns through substantially 90° in the region of the edge 7**.

Cowlings 12 have the same sectional shape as cowlings 11 and thus include a plane portion **12*a*, an arcuate portion 12*b* and a further plane portion 12*c*. The cowlings 12 are mounted around the side edges 9 in the same way as cowlings 11 are mounted on lower edge 7 such that portion 12*a* slopes towards the associated side surface 10 of the cupboard and air flow channels 18 are defined by the cowlings 12 in the same way as the channel 15 is defined by cowling 11**.

The lower ends of cowlings 12 are smoothly joined to cowling 11.

Cowling 13 provided on sash window 6 is of the same section as cowling 11 and thus includes a plane portion **13*a*, and arcuate portion 13*b* and a further plane portion 13*c*. Plane portion 13*a* slopes upwardly into the enclosure 2. The cowling 13 is mounted on sash window 6 such than an air flow channel is defined between cowling 13 and the lower edge of sash window 6**.

The function of cowlings 11, 12 and 13 will be described with reference to cowlings 11 only but it should be understood that cowlings 12 and 13 function in an analogous manner.

In use of the fume cupboard, fan 3 is operated to ventilate the enclosure 2. As a result there is a main air flow into the enclosure in the direction of arrows A. It should be noted that this main air flow is generally horizontal except near to the edges where it is convergent until it enters the cupboard and passes substantially at right angles through the plane of the access opening 5.

Additional to the main air flow depicted by arrows A are a streamlined air flow in direction of arrow B over cowling 11 and an air flow in direction of arrow C through channel 15.

Figure 5:
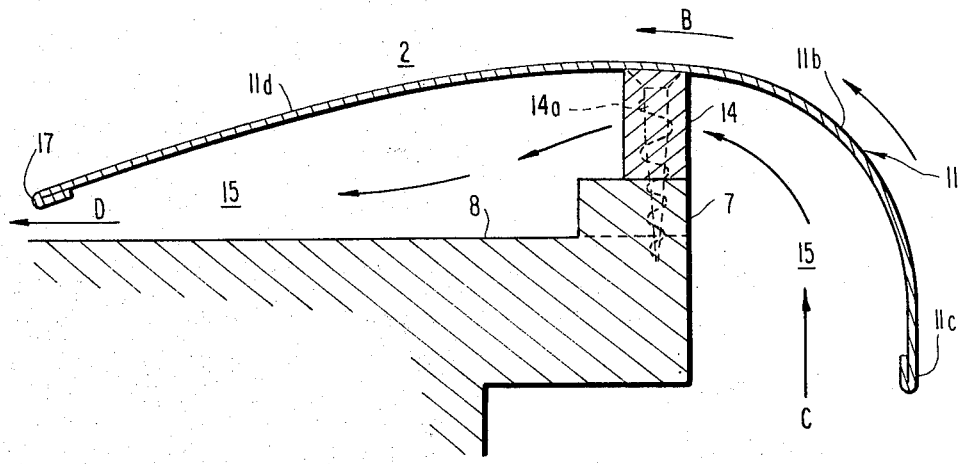
FIG. 5 is a diagrammatic sectional view of the lower edge of an alternate embodiment of the fume cupboard of FIG. 2.

The aerodynamic section of cowling 11 allows the streamlined flow over the cowling surface to be produced. The term streamlined air flow is used herein in the sense normally understood in aerodynamics, namely that the air flows in streams over the surface as a smooth flow and substantially without turbulence. Whilst passing over portion **11*b* the air flow is in aerodynamic terms, convergent with respect to the main air flow A whereas over portion 11*a* the flow is divergent with respect to the main air flow. If desired, as illustrated in FIG. 5, the portion 11*a* can be replaced by a portion 11*d* which is convex to the divergent air flow over the cowling. The convergent air flow over portion 11*b* of cowling 11 is streamlined and this streamlined convergent flow stabilises the main air flow entering the enclosure 2 and suppresses the generation of back flows upstream of the edge (i.e. outside the cupboard). The divergent air flow over portion 11*a* of cowling 11 is also streamlined and this streamlined divergent air flow suppresses the generation of back flows downstream of the cupboard edge. The shape of cowling 11** is such that there is a smooth transition of air flows from outside the cupboard to air flows inside the cupboard.

Air passing through air flow channel 15 along arrows C firstly enters the channel through entrance 16, is turned through 90° around the sill 7, and subsequently issues through exit 17 as an air stream D moving forwardly into the enclosure 2. Any turbulence of the air stream C between sill 7 and exit 17 is substantially eliminated by virtue of the ever decreasing height of the air flow channel beneath portion **11*a*** along the flow direction.

The air stream D aids the maintenance of a streamlined air flow over the downstream edge of portion **11*a* of cowling 11 with the result that the streamlined air flow leaves the downstream edge of portion 11*a* and continues to move forwardly into the enclosure 2** substantially without the formation of eddies or turbulence at this edge.

The net result is that air moving into the enclosure 2 around the sill 7 enters the enclosure 2 smoothly and substantially without the formation of eddies and turbulence Z (FIG. 1) such as would occur at the sill 7 had the cowling 11 not been provided.

The provision of the cowling 11 thus improves the containment of the cupboard in two ways. Firstly the absence of eddy formation in air streams passing into the cupboard around the sill 7 avoids containment problems normally associated with such eddies. Secondly the air stream D resists any backflows from eddies such as Y in FIG. 1.

As mentioned above, the cowlings 12 function in the same way as cowling 11. Similarly containment at the lower edge of sash window 6 is ensured by the cowling 13.

It should be noted that cowling 13 may be replaced by a cowling having a plane portion extending into the enclosure in a plane parallel to the floor surface 8. The use of such a cowling on the lower edge of a sash window is described and claimed in my copending application No. 042,666.

It will thus be appreciated that the cowlings 11–13 provide a simple and effective means of improving fume cupboard containment. It is of course possible to affix cowlings 11–13, which may be fabricated of metal, plastics or any other suitable material, to existing fume cupboards to obtain the benefits of the present invention.

What is claimed is:

1. A fume cupboard comprising a ventilated enclosure having an access opening with an edge, a cowling provided along said edge and spaced therefrom such that an air flow channel is defined between the edge and the cowling through which air may be drawn during use of the cupboard from the exterior to the interior of the enclosure, said cowling being shaped such that there is a streamlined air-flow over the cowling into the enclosure when the cupboard is in use, and said cowling having a first portion located outwardly of the enclosure and a second portion sloping into the enclosure such that the streamlined air flow over said second portion is divergent relative to the main air flow into the cupboard through the access opening.

2. A fume cupboard as claimed in claim 1 wherein the access opening has a basal edge associated with a floor of the enclosure and the cowling is provided along said basal edge with said second portion sloping towards said floor.

3. A fume cupboard as claimed in claim 1 wherein the access opening has two side edges each associated with a side wall of the enclosure and a said cowling is provided along each said side edge with its second portion sloping toward the respective side wall.

4. A fume cubpard as claimed in claim 1 wherein the access opening has an upper edge and a said cowling is provided along said edge with its second portion extending upwardly into the enclosure.

5. A fume cupboard as claimed in claim 2 wherein the access opening has the basal edge associated with a floor of the enclosure and two side edges each associated with a side wall of the enclosure and a said cowling is provided along each said side edge with its second portion sloping towards the respective side wall.

6. A fume cupboard as claimed in claim 5 wherein the access opening has an upper edge and a said cowling is provided along said upper edge with its second portion extending upwardly into the cupboard.

7. A fume cupboard as claimed in claim 2 wherein the access opening has an upper edge and a said cowling is provided along said upper edge with its second portion extending upwardly into the fume cupboard.

8. A fume cupboard as claimed in claim 1 wherein the streamlined air flow over the first portion of the cowling is convergent with respect to the main air flow through the access opening.

9. A fume cupboard as claimed in claim 8 wherein the first portion is convex to the streamlined air flow.

10. A fume cupboard as claimed in claim 8 wherein the second portion of the cowling is plane.

11. A fume cupboard as claimed in claim 8 wherein the second portion of the cowling is convex to the divergent air flow over the cowling.

12. A conversion kit for a fume cupboard comprising a ventilated enclosure having an access opening with an edge, the kit comprising a cowling for location along said edge and spaced therefrom such that an air flow channel is defined between the edge and the cowling when fitted, through which air may be drawn during use of the cupboard from the exterior to the interior of the enclosure, said cowling being shaped such that there will be a streamlined air flow over the cowling when fitted, into the enclosure when the cupboard is in use, and said cowling having a first portion for location outwardly of the enclosure and a second portion for sloping into the enclosure such that the streamlined air flow over said second portion is divergent relative to the main air flow into the cupboard through the access opening.

* * * * *